US009488999B2

(12) United States Patent
Mnich et al.

(10) Patent No.: US 9,488,999 B2
(45) Date of Patent: Nov. 8, 2016

(54) VOLTAGE REGULATOR FOR SYSTEMS WITH A HIGH DYNAMIC CURRENT RANGE

(71) Applicant: Aeroflex Colorado Springs Inc., Colorado Springs, CO (US)

(72) Inventors: Chris Mnich, Colorado Springs, CO (US); Jonathan Mabra, Colorado Springs, CO (US); Duane Slocum, Colorado Springs, CO (US)

(73) Assignee: Aeroflex Colorado Springs Inc., Colorado Springs, CO (US)

( * ) Notice: Subject to any disclaimer, the term of this patent is extended or adjusted under 35 U.S.C. 154(b) by 126 days.

(21) Appl. No.: 14/341,324

(22) Filed: Jul. 25, 2014

(65) Prior Publication Data

US 2016/0026196 A1 Jan. 28, 2016

(51) Int. Cl.

| | |
|---|---|
| ***G05F 1/59*** | (2006.01) |
| ***G05F 1/46*** | (2006.01) |
| ***G05F 1/56*** | (2006.01) |
| ***G05F 1/575*** | (2006.01) |
| *G05F 3/26* | (2006.01) |

(52) U.S. Cl.

CPC ..... *G05F 1/468* (2013.01); *G05F 1/56* (2013.01); *G05F 1/575* (2013.01)

(58) Field of Classification Search

CPC ..... G05F 1/56; G05F 1/565; G05F 1/575; G05F 1/59; G05F 3/26; G05F 3/262

USPC ..... 323/273, 274, 275, 281

See application file for complete search history.

(56) References Cited

U.S. PATENT DOCUMENTS

| | | | | |
|---|---|---|---|---|
| 6,522,111 | B2 * | 2/2003 | Zadeh | G05F 1/575 323/277 |
| 7,573,246 | B2 * | 8/2009 | Lin | G05F 1/575 323/273 |
| 7,977,931 | B2 * | 7/2011 | Wadhwa | G05F 1/565 323/314 |
| 2014/0176226 | A1 * | 6/2014 | Heo et al. | H03K 17/164 327/410 |

* cited by examiner

*Primary Examiner* — Gary L Laxton

(74) *Attorney, Agent, or Firm* — Peter J. Meza; Hogan Lovells US LLP

(57) ABSTRACT

A voltage regulator includes a reference current scaling circuit comprising an input reference current, a scaled output source current and a corresponding first bias voltage, and a scaled output sink current and a corresponding second bias voltage; and a decision making circuit having a first voltage input for receiving a first reference voltage, a second voltage input for receiving a second reference voltage, a third voltage input for receiving the first bias voltage, and a fourth voltage input for receiving the second bias voltage, and an output for providing a regulated voltage.

43 Claims, 7 Drawing Sheets

REFERENCE CURRENT SCALING CIRCUIT

COMPARATOR CONFIGURATION FOR PUSH/PULL OPERATION

VREG VERSUS TIME WITH VARYING CURRENT DEMANDS

CMR AND LDO REGULATORS WORKING IN TANDEM

VOLTAGE REGULATOR FOR SYSTEMS WITH A HIGH DYNAMIC CURRENT RANGE

FIELD OF THE INVENTION

The present invention relates to voltage regulators. More specifically, the present invention relates to a voltage regulator suitable for use in an integrated circuit application where the current demand can vary significantly in a short period of time.

BACKGROUND OF THE INVENTION

Many voltage regulators of various types are known in the art. However, there is still a need for a voltage regulator that can handle wide swings in load current while still maintaining voltage regulation. A voltage regulator is needed for an integrated circuit application where the current demand can vary significantly in a short period of time. The current can be small or large for any amount of time and abruptly change to the opposite demand condition without warning. In such a situation, it can be difficult to keep the regulated voltage within the required range needed to guarantee device performance.

SUMMARY OF THE INVENTION

The present invention uses a system of circuits to inject pre-determined amounts of current into and out of a regulated voltage node so as to provide a stable output voltage during large current demand transients. A system of voltage monitors detects droop and overshoot relative to a reference and either sinks or sources a fixed amount of current to quickly compensate the output voltage. The present invention includes a power savings mode for engaging subsequent regulator stages. The present invention quickly responds to large current demand changes, and no external signaling is required to enable the fast response voltage regulation. The circuit of the present invention can be used with any circuit technology. The switching regulator according to the present invention can be used alone or in tandem with a Low Drop-Out (LDO) type regulator. A tightly regulated output voltage can be achieved using multiple stages as is described in further detail below.

A voltage regulator according to the present invention comprises a reference current scaling circuit comprising an input reference current, a scaled output source current and a corresponding first bias voltage, and a scaled output sink current and a corresponding second bias voltage; and a decision making circuit having a first voltage input for receiving a first reference voltage, a second voltage input for receiving a second reference voltage, a third voltage input for receiving the first bias voltage, and a fourth voltage input for receiving the second bias voltage, and an output for providing a regulated voltage.

The reference scaling current comprises a first current mirror having an input for receiving the input reference current, a first output, and a second output; a second current mirror having an input coupled to the first output of the first current mirror, and an output; a first diode-connected transistor coupled to the output of the second current mirror for generating the first bias voltage; and a second diode-connected transistor coupled to the second output of the first current mirror for generating the second bias voltage. The first bias voltage is referenced to ground, and the second bias voltage is referenced to a supply voltage. The first current mirror comprises an N-channel current mirror, and the second current mirror comprises a P-channel current mirror. The first diode-connected transistor comprises an N-channel diode-connected transistor, and the second diode-connected transistor comprises a P-channel diode-connected transistor.

The decision making circuit comprises a first comparator having a first input coupled to the first voltage input of the decision making circuit, a second input coupled to the output of the decision making circuit, and an output; a second comparator having a first input coupled to the output of the decision making circuit, a second input coupled to the second voltage input of the decision making circuit, and an output; a first transfer gate having first and second inputs coupled to the output of the first comparator, a third input for receiving the second bias voltage, and an output; a second transfer gate having first and second inputs coupled to the output of the second comparator, a third input for receiving the first bias voltage, and an output; a first transistor having a gate coupled to the output of the first transfer gate and a current path coupled between a supply voltage and the output of the decision making circuit; and a second transistor having a gate coupled to the output of the second transfer gate and a current path coupled between the output of the decision making circuit and ground. The first transfer gate is coupled to the first comparator through a plurality of inverters, and the second transfer gate is coupled to the second comparator through a plurality of inverters. The first transfer gate comprises a P-channel transistor and an N-channel transistor in parallel connection, and the second transfer gate comprises a P-channel transistor and an N-channel transistor in parallel connection. The first transistor comprises a P-channel transistor, and the second transistor comprises an N-channel transistor.

The voltage regulator according to the present invention further comprises a filter capacitor coupled to the output of the decision making circuit. The voltage regulator according to the present invention can be used in conjunction with an LDO regulator.

According to another embodiment of the present invention, a voltage regulator comprises a plurality of connected stages, each stage comprising a reference current scaling circuit comprising an input reference current, a scaled output source current and a corresponding first bias voltage, and a scaled output sink current and a corresponding second bias voltage; and a decision making circuit having a first voltage input for receiving a first reference voltage, a second voltage input for receiving a second reference voltage, a third voltage input for receiving the first bias voltage, and a fourth voltage input for receiving the second bias voltage, and an output for providing a regulated voltage. According to this embodiment of the present invention the first and second reference voltages can be made different for each stage. This embodiment of the voltage regulator can also be used in conjunction with an LDO regulator.

DETAILED DESCRIPTION

The circuit of the present invention results in a tightly controlled output voltage even when the current draw on the voltage changes rapidly. This regulator method will be referred to as a current mode regulator (CMR); however, it does not require the use of any inductors as is typical with what is commonly referred to as a current mode regulator.

A key aspect of the circuit of the present invention is to use a system of comparators to determine whether the supply is in the process of drooping or overshooting relative to its target voltage and to use the output of comparators to digitally enable either the sourcing or sinking of a fixed amount of current per stage depending on whether the output voltage is under or over the target voltage. Several circuits are required to accomplish this task.

The first circuit that is needed is a reference current scaling circuit. This can be a simple set of current mirrors that is used to take a reference current and generate a bias voltage that is associated with a scale multiple of the reference current. Depending on the exact application, it may be necessary to generate these bias voltages for P-channel devices, N-channel devices, or both. In the embodiment shown in FIG. 1, both cases are shown for completeness.

Figure 1:
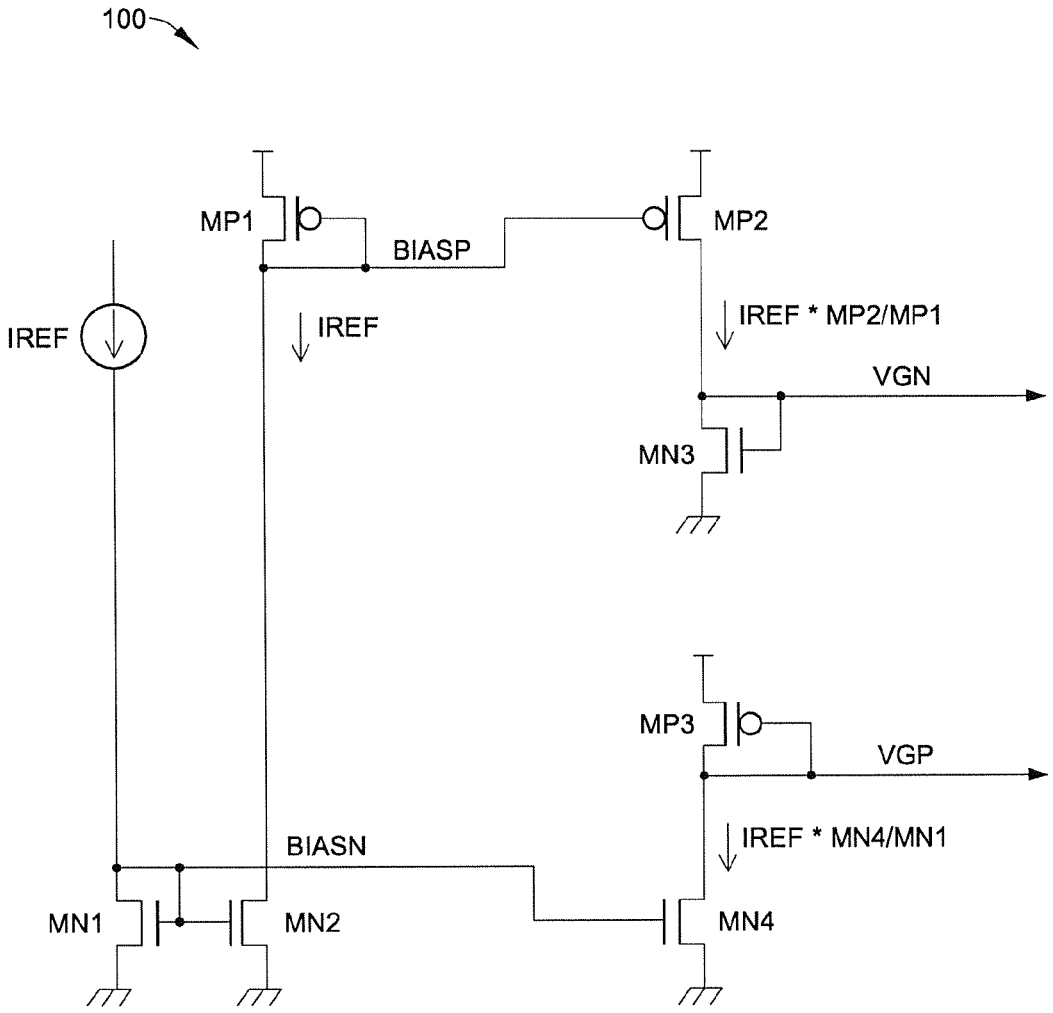
FIG. 1 is a circuit diagram of a reference current scaling circuit according to the present invention.

Referring to FIG. 1, a reference current scaling circuit 100 is shown. In circuit 100, an input current IREF is supplied to the diode connected n-channel transistor MN1, which generates a bias voltage (BIASN). This bias voltage is applied to the gate of transistor MN2, which is matched to device MN1 and therefore the current equal to IREF flows between the drain and source of transistor MN2. This path is connected to a diode connected p-channel transistor (MP1), which generates a bias voltage (BIASP). BIASN and BIASP are applied to the gates of transistors MN4 and MP2, respectively, to generate a current that is scaled relative to the input IREF. This scale is dependent on the size of transistor MP2 relative to the size of transistor MP1 and the size of transistor MN4 relative to transistor MN1. These scaled currents are applied to diode connected devices MN3 and MP3 to generate bias voltages VGN and VGP respectively. Transistors MN3 and MP3 will serve as index devices for the final output drivers of the voltage regulator; that is, bias voltages VGN and VGP will later be used to drive fixed amounts of current into and out of the regulated voltage supply. As is known in the art, transistors MN1, MN2, and MN4 form a two output current mirror, and transistors MP1 and MP2 form a single output current mirror.

Figure 2:
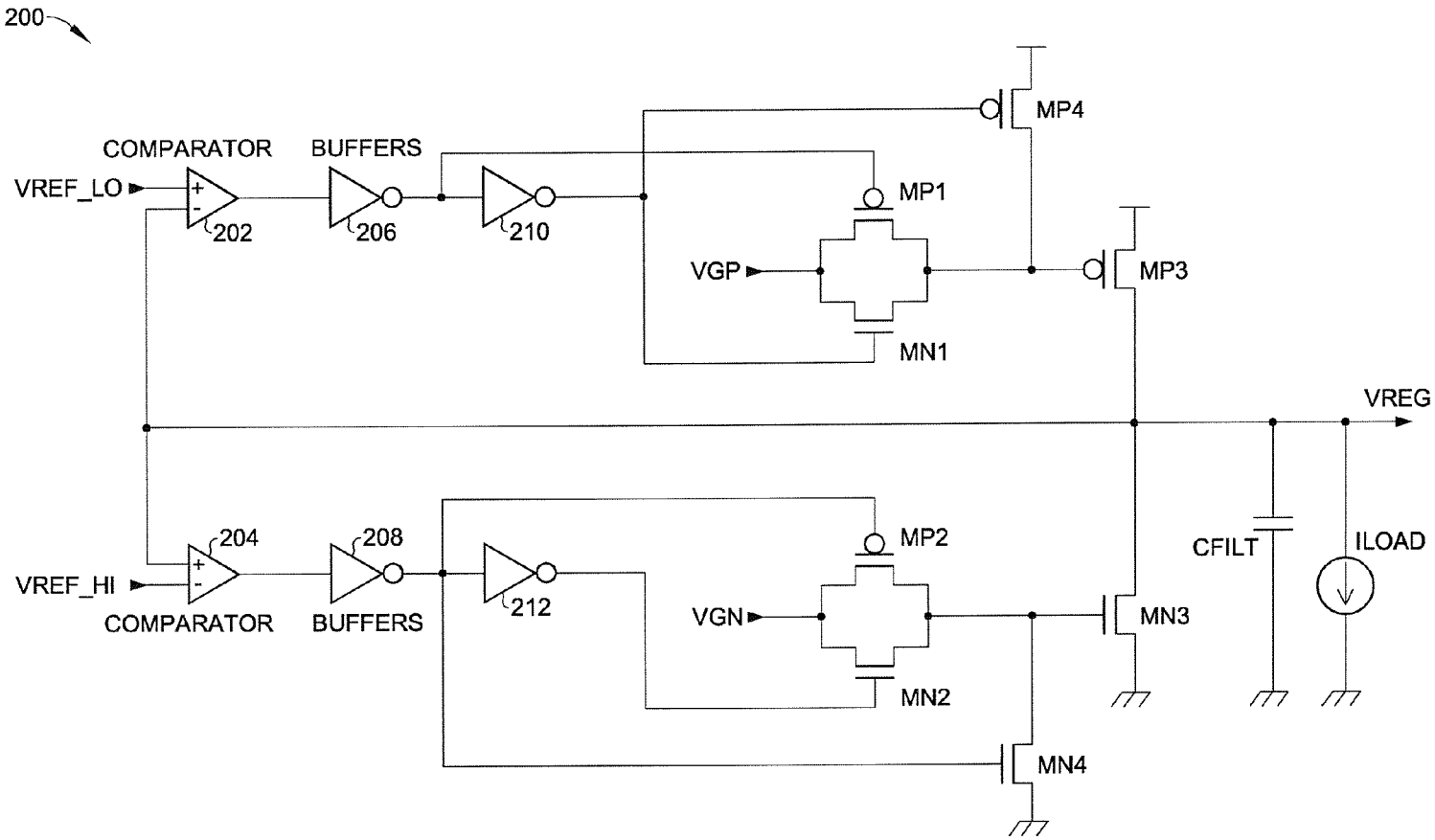
FIG. 2 is a circuit diagram of a decision making circuit according to the present invention used in conjunction with the reference scaling circuit according to the present invention to provide a voltage regulator.

The second circuit that is needed is a decision making circuit that determines whether or not to apply the current to the regulated voltage. FIG. 2 shows a decision making circuit 200 including a simplified push/pull configuration that serves to keep the regulated voltage between two separate reference voltages. Note that additional circuitry may be required for a complete realization of the concept presented here.

Referring to FIG. 2, two input reference voltages are brought into two separate comparators to show the pull-up (regulator) path and the pull-down (clamp) path. Depending on the application, one might use only one of the paths or different numbers of each type of stage. One reference voltage sets the lower target (VREF_LO) for the regulated voltage level while the second reference voltage sets the upper target (VREF_HI) for the regulated voltage level. The output voltage (VREG) is returned to both comparators 202 and 204. Note that in the case of the pull-up path, the reference voltage goes to the positive terminal and the output voltage goes to the negative terminal. In the pull-down path, the reference voltage and output voltages swap terminals. The pull-up path will open the transfer gate (MP1 and MN1) whenever VREG is below VREF_LO while the pull-down path will open the transfer gate (MP2 and MN2) whenever the VREG is above VREF_HI. When the pull-up path is engaged, the voltage on VGP is applied to the gate of MP3. VGP is the bias voltage set by the scaled reference current into the index device of MP3 in FIG. 1. Device MP3 in FIG. 2 can be scaled relative to device MP3 in FIG. 1 such that a specific output drive current is achieved for regulating the output voltage. Similarly, VGN is the bias voltage set by the scaled reference current into the index device MN3 in FIG. 1. Device MN3 in FIG. 2 can be scaled relative to device MN3 in FIG. 1 such that a specific output drive current is achieved for clamping the output voltage. CFILT represents the filter capacitance used to store charge for the device and ILOAD represents the current draw on the regulated voltage. Note that the gate of transistor MN1 is coupled to comparator 202 through inverters 206 and 210, and that the gate of transistor MP1 is coupled to comparator 202 through inverter 206. Note that the gate of transistor MN2 is coupled to comparator 204 through inverters 208 and 212, and that the gate of transistor MP2 is coupled to comparator 204 through inverter 208.

In FIG. 2, transistors MP4 and MN4 are added to show how transistors MP3 and MN3 have their gates biased when the transfer gates are closed. The purpose of transistors MP4 and MN4 is to turn off transistors MP3 and MN3 if the regulated voltage is above VREF_LO, in the case of transistor MP3, and below VREF_HI, in the case of transistor MN3. It is important to note that the pull-up side (controlling transistor MP3) can be completely independent from the pull-down side (controlling transistor MN3); that is, either side can be present without the other.

The circuitry shown in FIGS. 1 and 2 is somewhat similar to what is generally used for a VDD/2 generator in many memory devices; however, the significant difference being that instead of an op-amp driving the output devices directly (and thus obtaining a DC solution for a given load current), the circuits presented above never provide a DC solution unless there is no load current on the regulated voltage. In its more digital-like operation, the regulator of the present invention also somewhat resembles a pumped voltage type scheme where charge is injected into a node if it drifts too far away from the target voltage. Additionally, the regulated output voltage will ripple like it does for a pumped supply since a fixed amount of current is sourced/sunk to/from the regulated voltage (unless ILOAD is exactly equal to the fixed current determined by the current reference and scaling). However, unlike a pumped voltage, there is no need for an oscillator or clocking circuitry when the regulated voltage target lies between the external power supply and the external ground supply.

Figure 3:
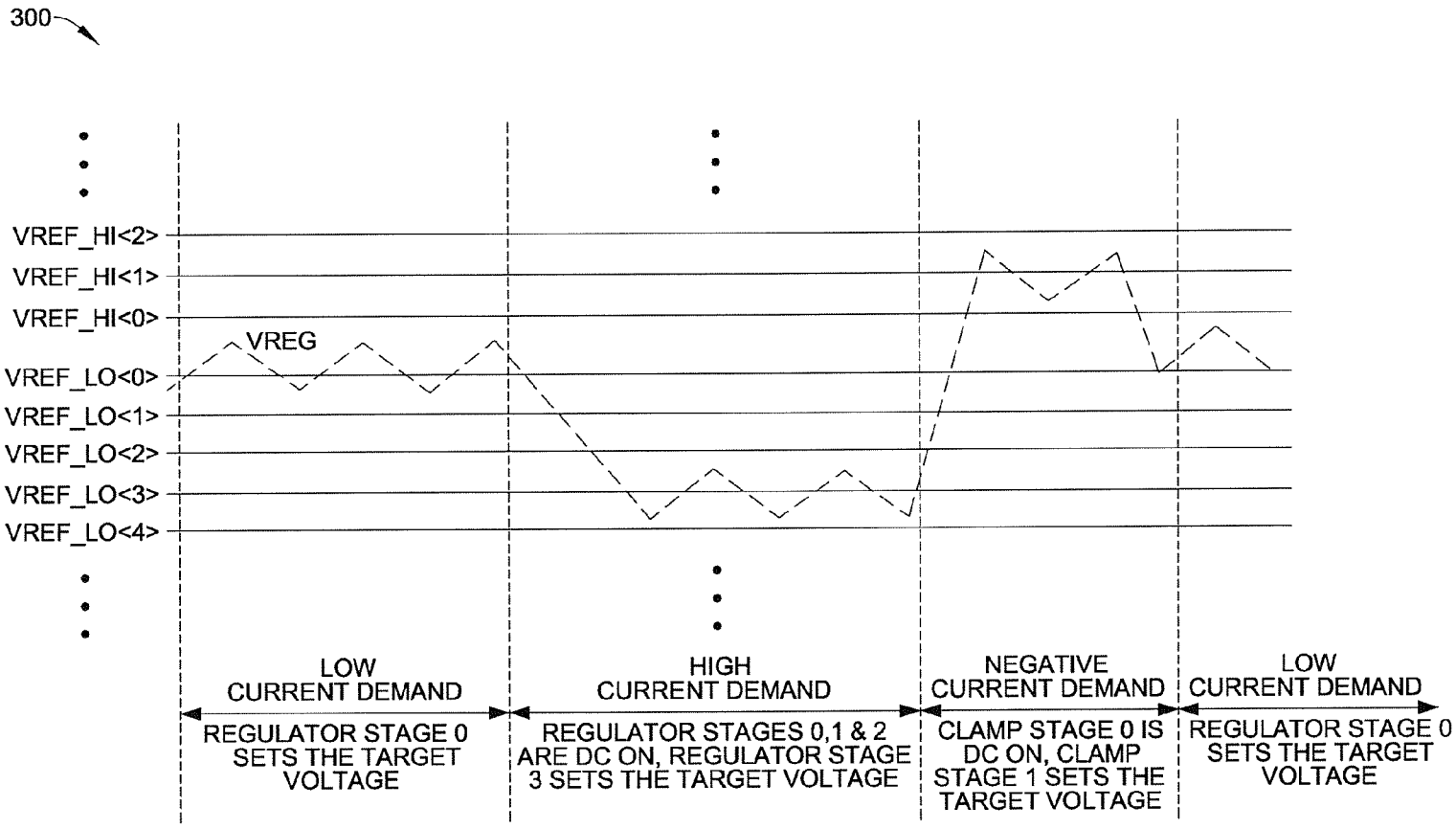
FIG. 3 is a plot of a regulated voltage versus current demand using the voltage regulator of the present invention.

This simple approach could work without any further modifications; however, in designing this circuit several improvements were made for various considerations. If one were to use only a single stage or multiple stages with identical reference voltages, the output ripple might be quite large since the available amount of current might need to be large to sustain continuous current draw. Additionally if the single stage approach does need to source or sink a large amount of current, then one must also consider inductive effects on the external supply that is used for generating the internal regulated voltage. To improve the behavior of this circuit, the circuitry shown above can be instantiated multiple times and each instantiation can have a slightly different reference voltage. In the case of the pull-up paths, the first stage would have the reference voltage set to the desired target, the second stage would have a reference voltage slightly below the desired target, the third stage would have a reference voltage slightly below the reference voltage for the second stage, and so forth for as many stages as are desired/required. Similarly, the first stage of the pull-down paths would have a reference voltage slightly above the desired target, the second stage would have a reference voltage slightly above that of the first stage, and so forth. The result of this technique is a series of steps that the output voltage will regulate depending on the current demand on the regulated voltage. Once the current load exceeds the capability of the first stage, the second stage will become the new voltage target. Another way to think of it is that the farther the regulated voltage moves from the true voltage target, the more current will be applied to the node to bring it back to the desired target. FIG. 3 shows in graph 300 how this staged regulator behaves under various current demand situations.

Another improvement is to use separate bias voltages (VGN and VGP) for every stage of the regulator. This allows each stage to have a different amount of current, if desired, and also provides improved immunity to capacitive kick-back effects from enabling and disabling multiple stages.

With the addition of multiple stages the current demand required to run the comparators and bias generators themselves increases, which works to decrease the overall efficiency of the system (available output current relative to required input current). In order to reduce the current requirement for the regulator itself, a novel improvement was devised. The improvement involves sending signals between different stages of the regulator system. In the case of the pull-up paths, the state of stage 0 can be sent to a stage with a lower reference voltage; in the present invention, the state of the comparator for stage 0 is sent to stage number 2, the state of the comparator for stage 1 is sent to stage number 3, etc. This state is simply a buffered signal from the comparator that indicates whether that particular stage is applying current to the regulated voltage or not. On the receiving side, these signals enable/disable some of the bias stages in the comparators when they are not needed to save power in stages that have lower reference voltages. The number of stages that are traversed by these signals are limited, but it is dependent on how fast the current demand can change, how much filter capacitance is on the regulated voltage, the speed required for maintaining the regulated voltage, and the allowable regulator efficiency in various modes of operation.

Figure 4:
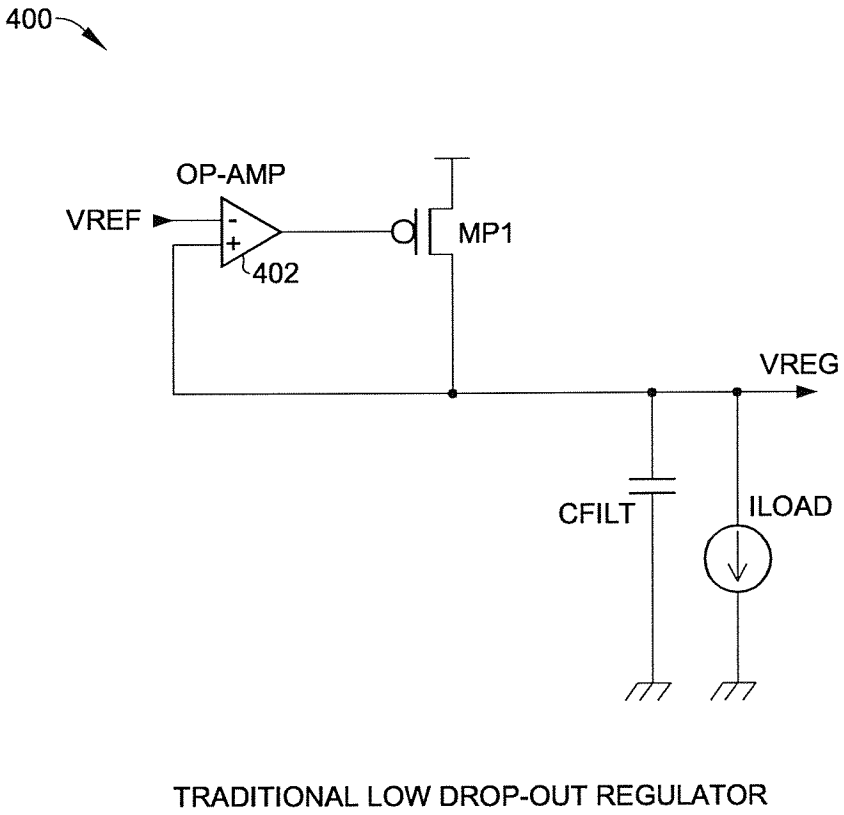
Fig. 4 Prior Art
FIG. 4 is a circuit diagram of a Low Drop-Out (LDO) Voltage Regulator according to the prior art.

The final improvement to this regulator system was to use it in tandem with a traditional low drop-out (LDO) style regulator, shown in FIG. 4. As is known in the art, LDO 400 includes an OP-AMP 402 having a negative input for receiving a VREF input voltage. The output of OP-AMP 402 is coupled to the gate of transistor MP1. The drain of transistor MP1 is coupled to the positive input of OP-AMP 402. The source of transistor MP1 is coupled to the supply voltage. The drain of transistor MP1 provides the regulated VREG voltage, and is coupled to the output filter capacitance CFILT as well as the load current ILOAD.

Figure 5:
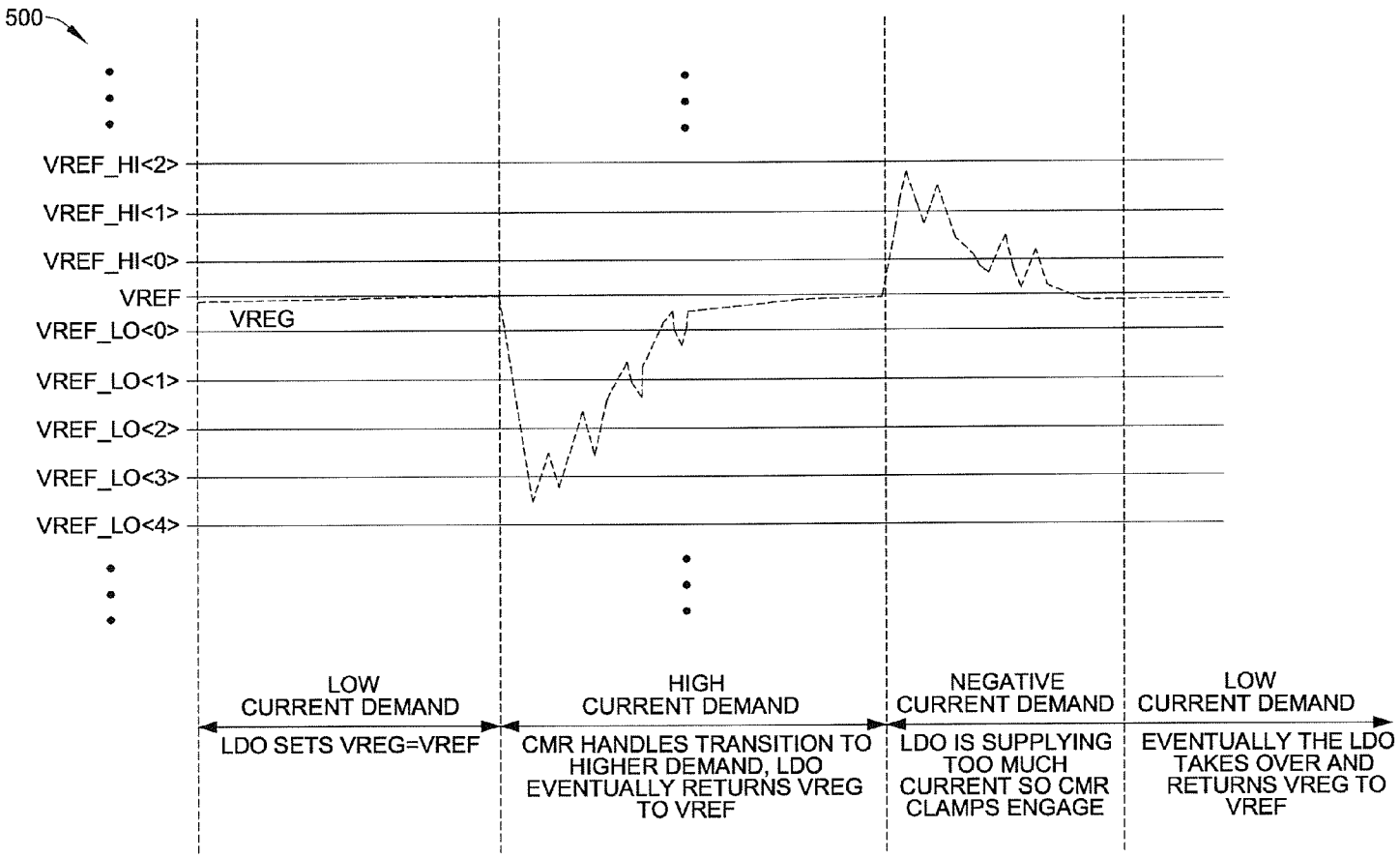
FIG. 5 is a plot of a regulated voltage versus current demand using the Current Mode Regulator (CMR) of the present invention in conjunction with the LDO regulator.

The LDO regulator can provide a true DC solution for any given current demand, but as discussed earlier, it can be too slow to respond to sudden, large changes in current demand. When used together, the CMR and the LDO regulator perform different tasks. The LDO regulator works to achieve a DC solution for the average current demand over a long period of time while the CMR helps during the transitions between different average current demands. In order to allow the LDO regulator to eventually take over full control of the output voltage, the CMR uses references voltages that are slightly above and below the true voltage target that is used for the LDO regulator. By providing this dead-band in the CMR, the LDO regulator has a region where it is the only component driving the regulated voltage. Consider that for a long time the current demand has been stable; in this situation the LDO will be driving the regulated voltage to the target voltage value and will be at a DC solution. Then the current demand goes up several factors almost instantaneously. The LDO regulator will work to try to keep the voltage on target, but it cannot respond quickly enough to keep the regulated voltage from drooping below the target voltage. As the regulated voltage droops through the reference voltages for the CMR, the pull-up stages engage and begin sourcing current into the regulated voltage. The additional current works to keep the regulated voltage close enough to the target voltage so as to guarantee device performance. Since the CMR pull-up stages shut off their current sources once the regulated voltage exceeds the reference voltage for those stages, the LDO will gradually take over full control of the new (higher) current demand. Now the current demand goes down by several factors almost instantaneously. The LDO begins to reduce the amount of current it is supplying to the regulated voltage, but it cannot respond quickly enough to keep the regulated voltage from overshooting the target voltage. As the regulated voltage overshoots the reference voltages for the CMR, the pull-down stages engage and begin sinking current from the regulated voltage. The additional current works to keep the regulated voltage in the target range to guarantee device performance. Since the CMR pull-down stages shut off their current sinks once the regulated voltage is beneath the reference voltage for those stages, the LDO will gradually take over full control of the new (lower) current demand. For short bursts into and out of these higher current states, the CMR will do more of the work since the current demand is constantly changing. For longer stretches of the same average current, the LDO regulator will do more of the work since the current demand is not changing as frequently. FIG. 5 depicts the description from above, showing in graph 500 the regulated output voltage VREG to various load conditions.

Figure 6:
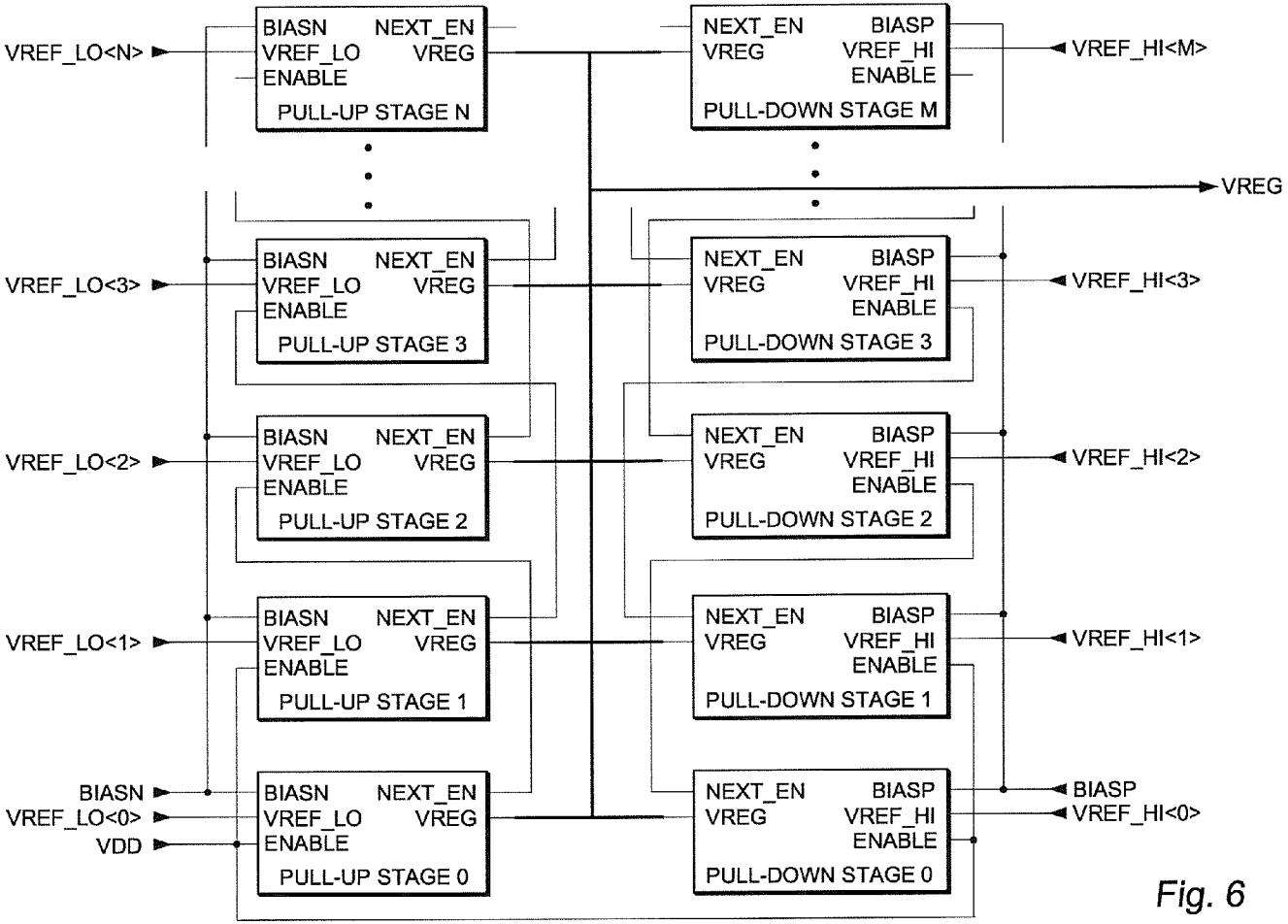
FIG. 6 is a circuit diagram of the CMR of the present invention including a multiple stage embodiment.

FIG. 6 is a circuit diagram of a CMR 600 according to the present invention including a system of multiples stages for both pull-up and pull-down configurations. There are "N" pull-up stages that each receives the BIASN voltage, a reference voltage, and an enable signal. Similarly, there are "M" pull-down stages that each receives the BIASP voltage, a reference voltage, and an enable signal. Note that the number of pull-up and pull-down stages can be different and the number of instances of each stage is dependent on the needs of the application. Each pull-up stage includes devices MP3 and MN4 (to generate a unique VGP bias voltage) and each pull-down stage includes devices MP2 and MN3 (to generate a unique VGN bias voltage) of the current scaling circuit shown in FIG. 1. Each pull-up stage includes a comparator that controls the application of the VGP bias voltage to the P-channel driver via the transfer gate. Each pull-down stage includes a comparator that controls the application of the VGN bias voltage to the N-channel driver via the transfer gate.

Each pull-up and pull-down stage connects to the VREG output and also generates an enable signal for a downstream stage of the same type. In FIG. 6, stages "0" and "1" are always enabled for both pull-up and pull-down and the power-saving enable signals are passed two stages downstream. Any number of stages can be traversed for the power-saving mode depending on the needs of a particular application.

In FIG. 6, "N" pull-up stages are shown, each of which generates a VGP voltage from a BIASN voltage for application to a pull-up device when the comparator in each stage determines that the VREG voltage is less than the input VREF_LO voltage to that stage. Correspondingly, "M" pull-down stages are shown, each of which generates a VGN voltage from the BIASP voltage for application to a pull-down device when the comparator in each stage determines that VREG is greater than the input VREF_HI to that stage.

In FIG. 6, the NEXT_EN signal for a pull-up stage is equivalent to the output of inverter 210 in FIG. 2 and the NEXT_EN signal for a pull-down stage is equivalent to the output of inverter 212 in FIG. 2. These signals may be used directly or re-buffered. The intent of these signals is to disable subsequent stages when they are not needed to save power and to enable them when they may be needed. Exactly how the power is saved using these signals is determined by the nature of the comparator design, but the general idea is to disable DC current paths that typically exist in comparator circuits. Consider a scenario where the current demand is low enough that only the first pull-up stage toggles on and off to regulate the voltage around the first VREF_LO level. If the current demand exceeds the current capacity of this first stage then the regulated voltage will always be lower than the VREF_LO level and thus the decision making circuit will hold the transfer gate open and the NEXT_EN signal from this stage will be asserted. At this point, the second pull-up stage will begin to regulate the output voltage to its VREF_LO level. The NEXT_EN signal to the third pull-up stage is asserted (again, sent from the first pull-up stage) in order to prepare the that stage to supply additional current into the regulated voltage since it will be needed if the current load continues to increase beyond the combined capacity of the first two pull-up stages. When the current load decreases to a level less than the current capacity of the first stage, then the NEXT_EN signal to the third pull-up stage is de-asserted to allow that stage to power-gate any circuitry that is not needed until the current load starts to increase again (and thus the regulated voltage starts to droop). In other words, the NEXT_EN signals in the pull-up stages are used to arm subsequent stages as the regulated voltage begins to droop and disarm previous stages as the regulated voltage rises back to the target voltage. Similarly, the NEXT_EN signals in the pull-down stages are used to arm subsequent stages as the regulated voltage begins to overshoot the target voltage and disarm previous stages as the regulated voltages falls back to the target voltage.

Figure 7:
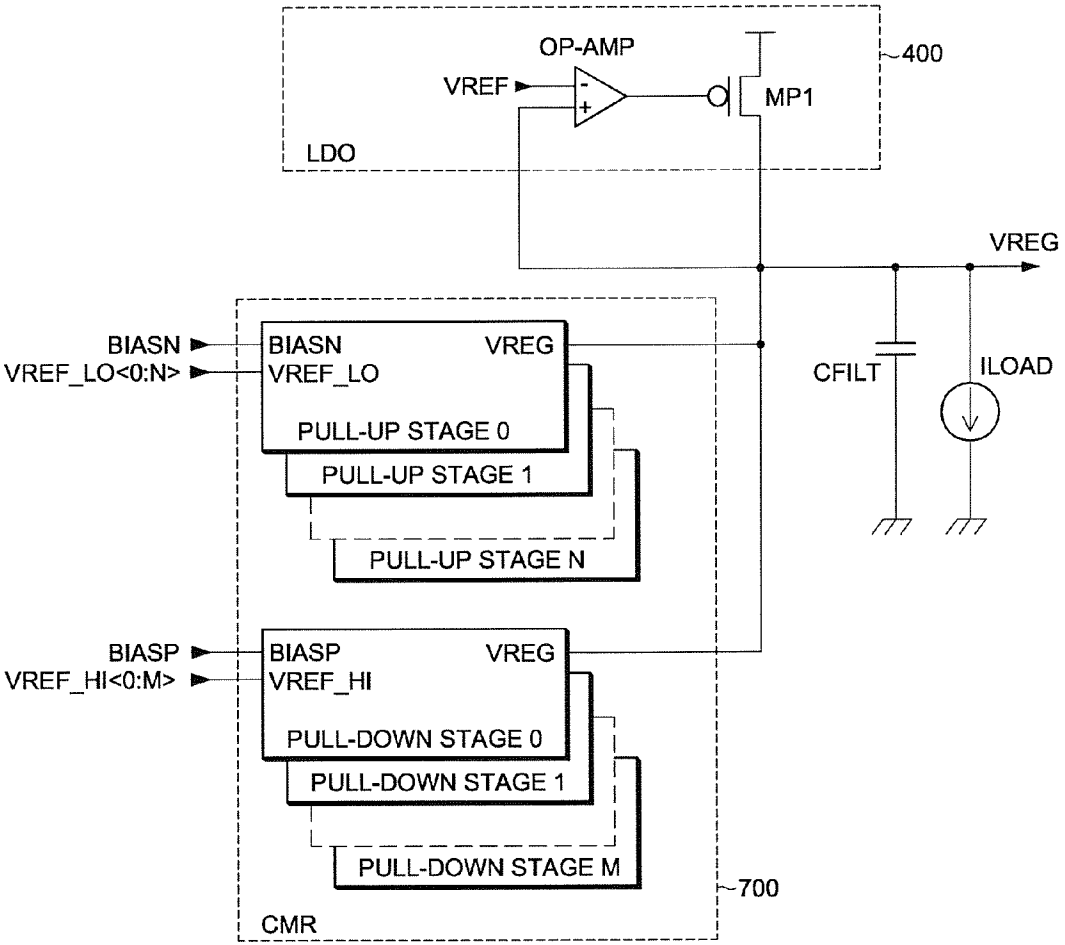
FIG. 7 is a circuit diagram of the CMR of the present invention operating in conjunction with an LDO.

FIG. 7 is a circuit diagram depicting the use of an LDO regulator 400 in conjunction with the CMR regulator 700 of the present invention. In FIG. 7, the CMR is shown in the multiple stage configuration for both pull-up and pull-down functions. The LDO regulator receives a reference voltage (VREF) and compares it to the regulated output voltage (VREG). The VREF voltage lies at a level between the VREF_LO<0> and VREF_HI<0> voltages. By providing a dead-band between the first CMR pull-up stage and the first CMR pull-down stage, a region exists where only the LDO is active and a DC voltage is achieved. When the load on the regulated voltage changes rapidly and VREG transitions out of the dead-band of the CMR, the CMR stages engage to maintain an acceptable regulated voltage for device performance and bring the voltage back to this dead-band region where the LDO is in full control of the regulated voltage.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A voltage regulator comprising:

a reference current scaling circuit comprising an input reference current, a scaled output source current and a corresponding first bias voltage, and a scaled output sink current and a corresponding second bias voltage; and a decision making circuit having a first voltage input for receiving a first reference voltage, a second voltage input for receiving a second reference voltage, a third voltage input for receiving the first bias voltage, and a fourth voltage input for receiving the second bias voltage, and an output for providing a regulated voltage.

2. The voltage regulator according to claim 1 wherein the reference scaling current comprises:

a first current mirror having an input for receiving the input reference current, a first output, and a second output;

a second current mirror having an input coupled to the first output of the first current mirror, and an output;

a first diode-connected transistor coupled to the output of the second current mirror for generating the first bias voltage; and a second diode-connected transistor coupled to the second output of the first current mirror for generating the second bias voltage.

3. The voltage regulator according to claim 2 wherein the first bias voltage is referenced to ground.

4. The voltage regulator according to claim 2 wherein the second bias voltage is referenced to a supply voltage.

5. The voltage regulator according to claim 2 wherein the first current mirror comprises an N-channel current mirror.

6. The voltage regulator according to claim 2 wherein the second current mirror comprises a P-channel current mirror.

7. The voltage regulator according to claim 2 wherein the first diode-connected transistor comprises an N-channel diode-connected transistor.

8. The voltage regulator according to claim 2 wherein the second diode-connected transistor comprises a P-channel diode-connected transistor.

9. The voltage regulator according to claim 1 wherein the decision making circuit comprises:

a first comparator having a first input coupled to the first voltage input of the decision making circuit, a second input coupled to the output of the decision making circuit, and an output;

a second comparator having a first input coupled to the output of the decision making circuit, a second input coupled to the second voltage input of the decision making circuit, and an output;

a first transfer gate having first and second inputs coupled to the output of the first comparator, a third input for receiving the second bias voltage, and an output;

a second transfer gate having first and second inputs coupled to the output of the second comparator, a third input for receiving the first bias voltage, and an output;

a first transistor having a gate coupled to the output of the first transfer gate and a current path coupled between a supply voltage and the output of the decision making circuit; and a second transistor having a gate coupled to the output of the second transfer gate and a current path coupled between the output of the decision making circuit and ground.

10. The voltage regulator according to claim 9 wherein the first transfer gate is coupled to the first comparator through a plurality of inverters.

11. The voltage regulator according to claim 9 wherein the second transfer gate is coupled to the second comparator through a plurality of inverters.

12. The voltage regulator according to claim 9 wherein the first transfer gate comprises a P-channel transistor and an N-channel transistor in parallel connection.

13. The voltage regulator according to claim 9 wherein the second transfer gate comprises a P-channel transistor and an N-channel transistor in parallel connection.

14. The voltage regulator according to claim 9 wherein the first transistor comprises a P-channel transistor.

15. The voltage regulator according to claim 9 wherein the second transistor comprises an N-channel transistor.

16. The voltage regulator according to claim 1 further comprising a filter capacitor coupled to the output of the decision making circuit.

17. The voltage regulator according to claim 1 further comprising a Low Drop-Out regulator.

18. A voltage regulator comprising:

a plurality of connected stages, each stage comprising:

a reference current scaling circuit comprising an input reference, a scaled output source current and a corresponding first bias voltage, and a scaled output sink current and a corresponding second bias voltage; and a decision making circuit having a first voltage input for receiving a first reference voltage, a second voltage input for receiving a second reference voltage, a third voltage input for receiving the first bias voltage, and a fourth voltage input for receiving the second bias voltage, and an output for providing a regulated voltage.

19. The voltage regulator according to claim 18, wherein the first and second reference voltages are different for each stage.

20. The voltage regulator according to claim 18 further comprising a Low Drop-Out regulator.

21. A voltage regulator comprising:

a reference current scaling circuit comprising an input reference current, a scaled output current, and a corresponding bias voltage; and a decision making circuit having a first voltage input for receiving a reference voltage, a second voltage input for receiving the bias voltage, and an output for providing a regulated voltage, wherein the voltage regulator is configured to switch the scaled output current applied to the regulated voltage output off and on via the decision making circuit to achieve voltage regulation, and wherein the scaled output current is a fixed amount of current and independent of the load current at the regulated voltage output.

22. The voltage regulator of claim 21 wherein the scaled output current comprises a source current.

23. The voltage regulator of claim 21 wherein the scaled output current comprises a sink current.

24. The voltage regulator of claim 21 wherein the bias voltage comprises a bias voltage referenced to ground.

25. The voltage regulator of claim 21 wherein the bias voltage comprises a bias voltage referenced to a power supply voltage.

26. The voltage regulator of claim 21 wherein the decision making circuit comprises a pull-up stage.

27. The voltage regulator of claim 21 wherein the decision making circuit comprises a pull-down stage.

28. The voltage regulator of claim 21 further comprising a Low Drop-Out regulator.

29. The voltage regulator of claim 21 wherein the polarity of the fixed amount of current is dependent on whether the decision making circuit is configured as a pull-up stage or a pull-down stage.

30. A voltage regulator comprising:

N pull-up stages each receiving a first bias voltage, a first reference voltage, and each pull-up stage having a regulated voltage output, wherein the regulated voltage output of each of the N pull-up stages are coupled together to a common regulated voltage output; and M pull-down stages each receiving a second bias voltage, a second reference voltage, and each pull-down stage having a regulated voltage output, wherein the regulated voltage output of each of the M pull-down stages are coupled together to the common regulated voltage output, wherein M and N are integers greater than or equal to two, and wherein each pull-up stage comprises a reference current scaling circuit comprising an input reference, a scaled output current, and a corresponding bias voltage; and a decision making circuit having a first voltage input for receiving a reference voltage, a second voltage input for receiving the bias voltage, and an output for providing the regulated voltage.

31. The voltage regulator of claim 30 wherein M and N are different.

32. The voltage regulator of claim 30 wherein M and N are equal.

33. The voltage regulator of claim 30 wherein each of the pull-up stages receives an enable signal.

34. The voltage regulator of claim 30 wherein each of the pull-down stages receives an enable signal.

35. The voltage regulator of claim 30 further comprising a Low Drop-Out regulator.

36. The voltage regulator of claim 30 wherein each pull-down stage comprises:

a reference current scaling circuit comprising an input reference, a scaled output current, and a corresponding bias voltage; and a decision making circuit having a first voltage input for receiving a reference voltage, a second voltage input for receiving the bias voltage, and an output for providing the regulated voltage.

37. A voltage regulator comprising:

N pull-up stages each receiving a first bias voltage, a first reference voltage, and each pull-up stage having a regulated voltage output, wherein the regulated voltage output of each of the N pull-up stages are coupled together to a common regulated voltage output; and M pull-down stages each receiving a second bias voltage, a second reference voltage, and each pull-down stage having a regulated voltage output, wherein the regulated voltage output of each of the M pull-down stages are coupled together to the common regulated voltage output, wherein M and N are integers greater than or equal to two, and wherein each pull-down stage comprises a reference current scaling circuit comprising an input reference, a scaled output current, and a corresponding bias voltage; and a decision making circuit having a first voltage input for receiving a reference voltage, a second voltage input for receiving the bias voltage, and an output for providing the regulated voltage.

38. The voltage regulator of claim 37 wherein M and N are different.

39. The voltage regulator of claim 37 wherein M and N are equal.

40. The voltage regulator of claim 37 wherein each of the pull-up stages receives an enable signal.

41. The voltage regulator of claim 37 wherein each of the pull-down stages receives an enable signal.

42. The voltage regulator of claim 37 further comprising a Low Drop-Out regulator.

43. The voltage regulator of claim 37 wherein each pull-up stage comprises:

a reference current scaling circuit comprising an input reference, a scaled output current, and a corresponding bias voltage; and a decision making circuit having a first voltage input for receiving a reference voltage, a second voltage input for receiving the bias voltage, and an output for providing the regulated voltage.

* * * * *